US005718368A

United States Patent [19]

Rench et al.

[11] Patent Number: 5,718,368

[45] Date of Patent: Feb. 17, 1998

[54] FOOD CONTAINER

[75] Inventors: Frederick A. Rench, Boise; Michael E. Watanabe; Dale J. Waite, both of Nampa, all of Id.; Mark A. Porter, Portland, Oreg.

[73] Assignee: Boise Cascade Corporation, Boise, Id.

[21] Appl. No.: 590,393

[22] Filed: Jan. 25, 1996

[51] Int. Cl.[6] ..... B65D 5/22; B65D 5/66

[52] U.S. Cl. ..... 229/109; 229/114; 229/148; 229/160.2; 229/906

[58] Field of Search ..... 229/109, 110, 229/114, 125.27, 148, 160.2, 902, 906

[56] References Cited

U.S. PATENT DOCUMENTS

| | | | |
|---|---|---|---|
| 2,839,236 | 6/1958 | Dunning | 229/148 |
| 3,623,650 | 11/1971 | Watts | 229/148 |
| 4,054,241 | 10/1977 | Meyers et al. . | |
| 4,470,538 | 9/1984 | Heathcock et al. | 229/23 R |
| 4,763,832 | 8/1988 | Forbes, Jr. | 229/114 |
| 4,765,534 | 8/1988 | Zion et al. | 229/109 |
| 4,793,546 | 12/1988 | Nunn | 229/109 |
| 4,930,681 | 6/1990 | Fultz et al. | 229/114 |
| 4,960,238 | 10/1990 | Lorenz | 229/125.29 |
| 4,979,667 | 12/1990 | Seaman | 229/906 |
| 4,984,734 | 1/1991 | Zion et al. | 229/906 |
| 5,044,549 | 9/1991 | Beales | 229/125.27 |
| 5,071,062 | 12/1991 | Bradley et al. | 229/109 |
| 5,118,032 | 6/1992 | Geho | 229/110 |
| 5,226,587 | 7/1993 | Eisman et al. | 229/110 |
| 5,249,736 | 10/1993 | Eisman | 229/110 |
| 5,402,930 | 4/1995 | Storms et al. | 229/125.28 |

*Primary Examiner*—Gary E. Elkins

*Attorney, Agent, or Firm*—Klarquist Sparkman Campbell Leigh & Whinston, LLP

[57] ABSTRACT

A food container consisting of a top and a bottom having obliquely angled side elements is disclosed. The container may be cut from a single blank of container material and formed into a hingedly connected top and bottom. When the top and bottom are open and substantially coplanar the obliquely angled sides permit multiple boxes or containers to be nested within one another for efficient stacking. A preferred embodiment includes tops and bottoms with eight side elements comprising one piece side elements and side elements having overlapping panels. When closed, the top side elements overlap the bottom side elements. The container also includes a locking tongue and opening which receives the tongue. A tab may be provided to assist in moving the tongue to disengage it from the opening.

46 Claims, 4 Drawing Sheets

FOOD CONTAINER

BACKGROUND OF THE INVENTION

1. Field of the Invention

This invention pertains to food containers and blanks that can be preassembled into containers for transporting prepared foods such as pizza and hamburgers.

2. Description of the Related Art

Cardboard and corrugated paper are useful for temporary storage and transportation of food products because of their low cost, ease of handling, and general consumer satisfaction. Such food containers are used for pizzas, hamburgers, and other food items that are partially or fully prepared and served to a consumer for "take out," that is off-premise consumption. Many hundreds of thousands of such containers are used every week. Because of this heavy consumption there is substantial competition to develop better, less expensive, and unique containers to address the ongoing need.

SUMMARY OF THE INVENTION

The present invention provides a unique and cost effective food container that can be preassembled and shipped to a retail food outlet. The preassembled containers can be nested together for space-efficient shipment and storage.

A preferred embodiment of the present invention is a blank of container material, such as corrugated paper or cardboard, that has been cut and scored to form first and second panel groups that are hingedly connected. Each panel group includes a central panel having hingedly connected side panels located around its perimeter. Different types of side panels include planar side panels and composite side panels ("composite" because it has two types of panels). The composite side panels have a web panel that has connector panels hingedly connected to one or both distal ends.

On the second panel groups one or more side panels include an extending support panel which is hingedly connected to a tongue panel. The tongue panel includes a tongue. Among the first panel group, one or more side panels include an opening for receiving the tongue. The tongue can engage the opening to lock together top and bottom portions of the assembled container.

The container is assembled from the blank preferably by bending the side panels upward at oblique angles to the central panel and adhering the connector panels to adjacent planar panels thus forming a dished top and bottom that are hingedly connected together.

Preferably, the food container includes eight side panels so that the assembled container has eight side elements. (Note that some side elements include a planar panel and overlapping connector panels.) The hinge connection between the top and bottom is located along rear side elements. Directly opposite are front side elements. The tongue panels and openings are located on side elements adjacent that front side element. Thus, the preferred embodiment includes two locking mechanisms.

Additionally, one rear side panel that is hingedly connected to the other rear side element, is more narrow than the other side panels. Thus, when the container is assembled and brought into locking engagement, the side elements of one panel group overhang the side elements of the other panel group thus producing a unique appearance. In the preferred embodiment the top side elements overhang the bottom side elements.

The side elements are oblique to the center panels to permit nesting. When a first container is open so that the top and bottom are substantially coplanar, a second container may be nested into the first container. Nesting allows assembled boxes to be efficiently stacked for shipment and storage.

Various advantages and features of novelty which characterize the invention are particularized in the claims. However, for a better understanding of the invention and its advantages, refer to the drawings and the accompanying description which illustrate and describe preferred embodiments of the invention.

DETAILED DESCRIPTION OF THE PREFERRED EMBODIMENTS

Figure 5:
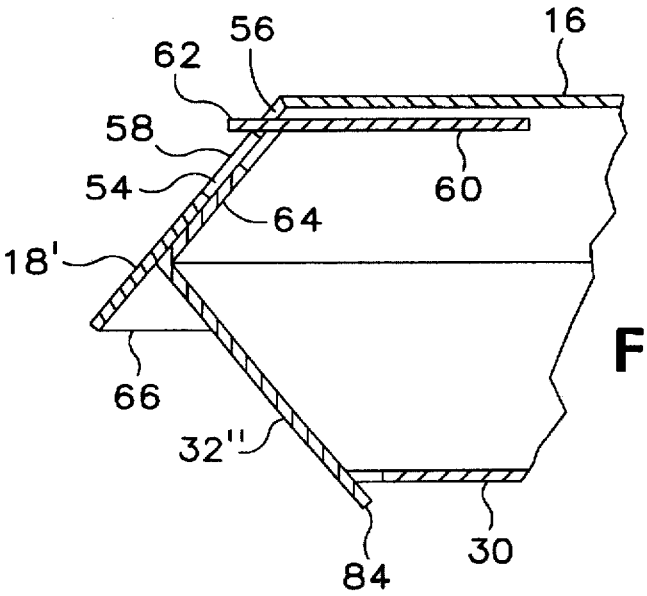
FIG. 5 is an enlarged, partial cross section view of the container of FIG. 1 taken along line 5—5.
Figure 6:
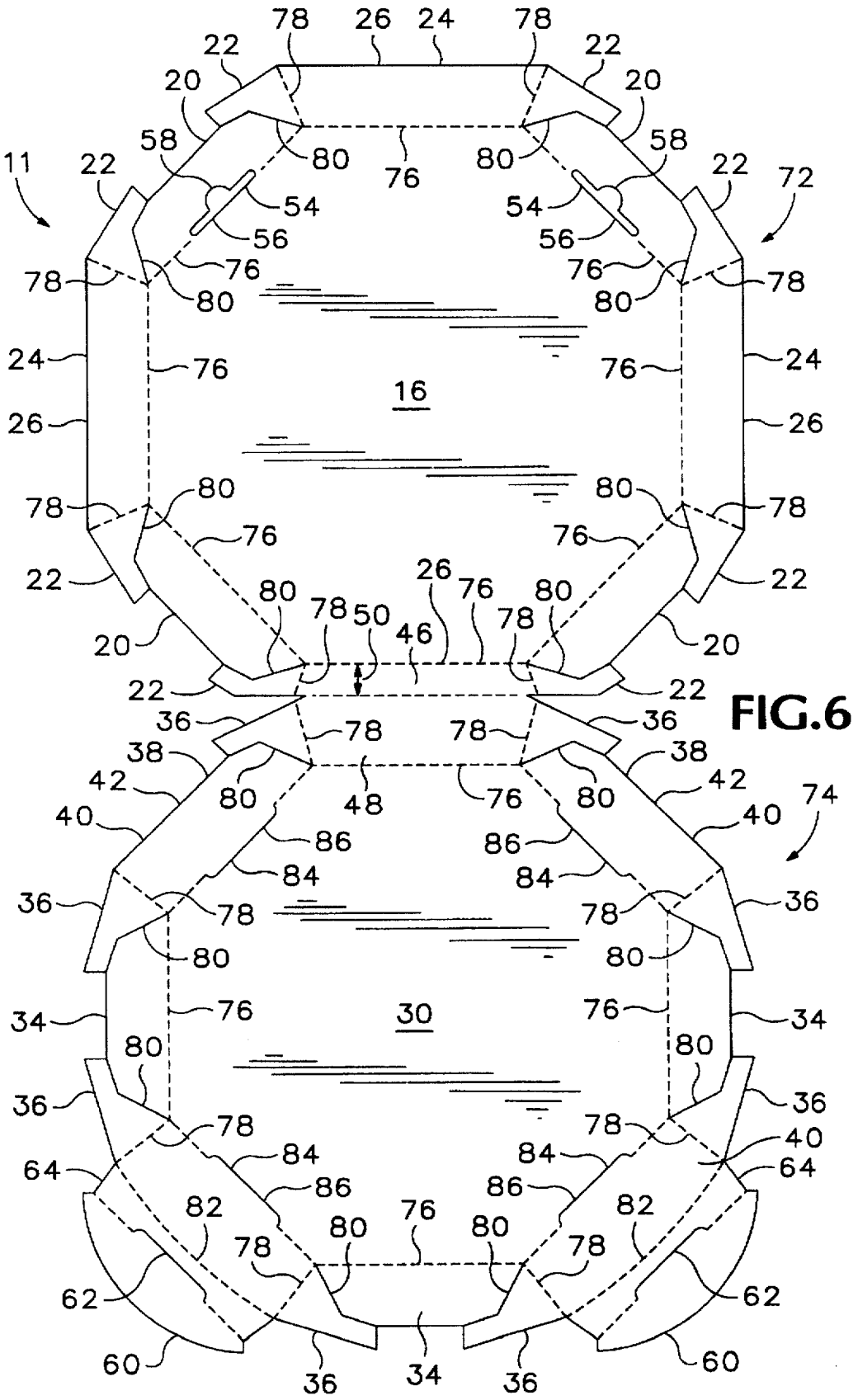
FIG. 6 is a top plan view of a blank that can be assembled to construct the container of FIG. 1.

A preferred embodiment of a container 10 of the present invention is shown assembled in FIGS. 1–5. FIG. 6 shows a top view of a blank 11 that can be formed into the container of FIGS. 1–5. Preferably, the blank 11 is die cut of a suitable container material such as corrugated paper board, cardboard, or even styrofoam. Other suitable container materials may also be used.

FIGS. 1–5 illustrate constructed food container 10. Using the orientation shown in the figures as a reference, the container includes a bottom 12 and a top 14. The top includes a central planar surface 16 that has contiguous side elements 18 located around its perimeter. The side elements form an oblique angle with the central planar surface 16.

In the preferred embodiment, there are two types of top side elements 18: side elements 18' having overlapping panels and side elements 18" without overlapping panels. The side elements 18' having overlapping panels comprise a planar side panel 20 adhered to one or more connector panels 22. The connector panels are a part of a composite side panel 24 ("composite" because it has two types of panels) which include a web panel 26 that hingedly supports the connector panels 22. When the connector panels 22 are adhered to the adjacent planar side panels 20 they are arranged so that adjacent side elements are at oblique angles relative to one another. Thus, the side elements 18 form an oblique angle to the central planar surface 16 and to adjacent side elements.

The bottom 12 also includes a central planar surface 30 which likewise has a plurality of side elements 32 hingedly connected to its perimeter. Similarly to the top, the side elements 32 are arranged to be oblique to the central planar surface 30 and to each other. In addition, the bottom side elements 32 include side elements 32' having overlapping panels and side elements 32" which have no overlapping panels. The overlapping panels comprise a bottom planar side panel 34 and overlapping connector panels 36 which are hingedly connected to web panels 38. Together, the web panels 38 and the connector panels 36 form bottom composite side panels 40. The bottom 12 further includes composite side panels 42 that have only one connector panel 36. The remaining composite side panels 40 include two connector panels 36.

The top 14 and bottom 12 each include rear side panels 46 and 48, respectively, that are hingedly connected together thus hingedly connecting the top and bottom. The top rear side panel 46 has a width 50 that is more narrow than a width associated with other top side panels 20, 24. Alternative embodiments include a top 14 and bottom 12 formed from separate blanks.

The top and bottom may be lockingly engaged by a tongue and slot engagement mechanism. In a first embodiment, two side elements 18 of the top 14 include an opening 54 have a slot aperture 56 and arcuate aperture 58. On corresponding bottom side elements 32 there are tongue panels 60 with tongues 62. The tongue panels are supported on respective support panels 64 which are resiliently and hingedly connected to bottom side panels 40. Inward motion of the support panels 64 and tongue panels 60 is compliantly resisted by the resilient hinge between the support panel 64 and the side panel 40. The resilient hinges are defined by arcuate score lines 82 (FIG. 6). As the top is closed onto the bottom the corresponding top side element 18 pushes the tongue panel 60 back until the tongue 62 and slot aperture 56 are oriented. The tongue 62 then springs into the slot aperture 56 engaging the top to the bottom. As noted, when thus engaged, the top side elements 18 overhang the bottom side elements 32 as best seen in FIG. 5 by overhang 66.

The tongue 62 is disengaged from the slot aperture 56 by pressing a finger against the exposed end of the tongue 62 thus pushing the support panel 64 and tongue panel 60 inward until the tongue 62 moves inward from the slot aperture 56. Pushing directly on the tongue 62 is preferred because it is furthest from the hinge (defined by score line 82); thus, pushing on the tongue creates the longest movement arm for best mechanical advantage.

Figure 7:
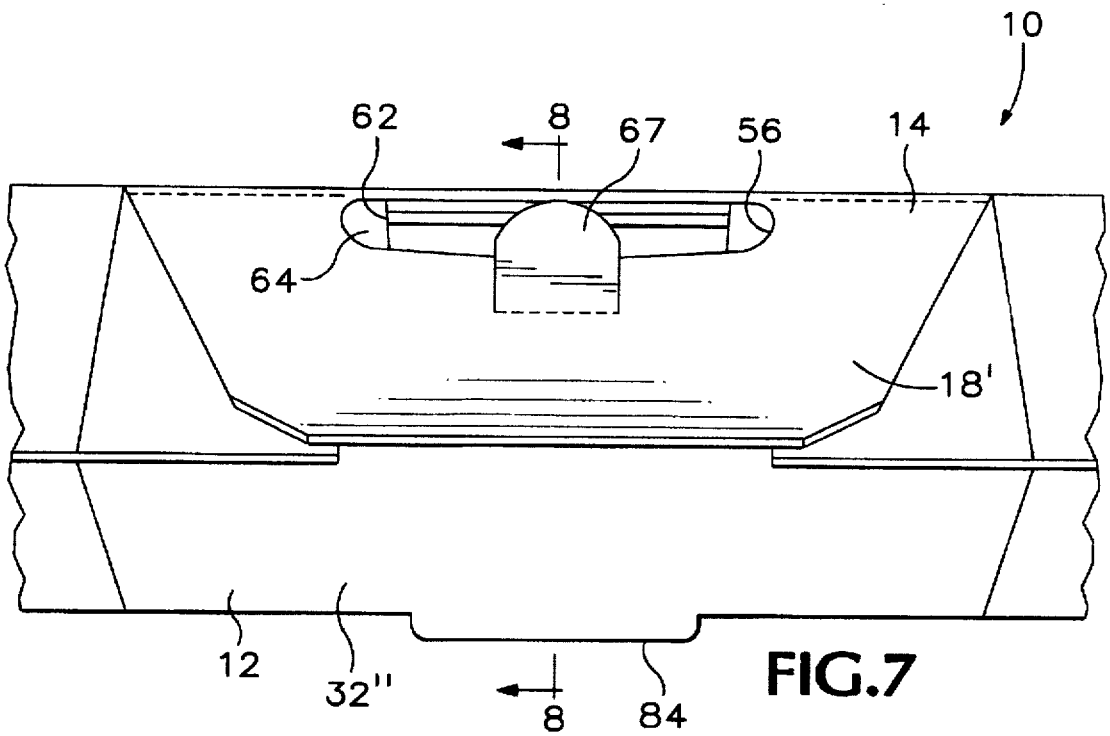
FIG. 7 is an enlarged elevation view of a portion of the food container with an alternative embodiment locking mechanism.
Figure 8:
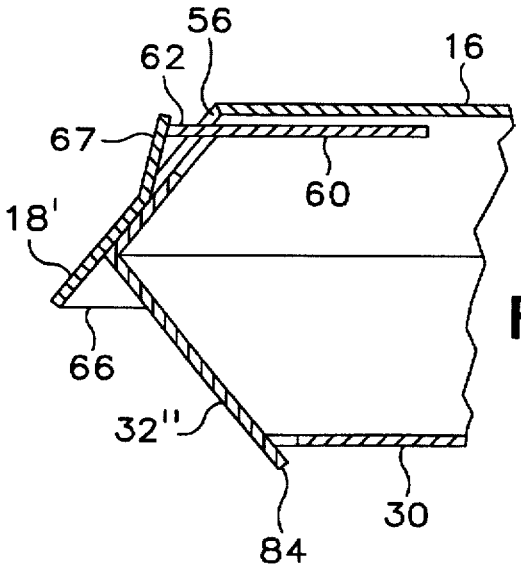
FIG. 8 is a cross-section view taken along line 8—8 of FIG. 7.

An alternative embodiment is shown in FIGS. 7 and 8. This embodiment includes tongue 62 engaging slot aperture 56 and a push tab 67 that is hingedly connected to the side element 18. The tab 67 is cut from the side element 18 and forced outward by the tongue 62 when the tongue is engaged in the slot aperture 56. Accordingly, the tab 67 is biased into contact with the tongue 62. The tab 67 facilitates disengaging the tongue 62 from aperture 56.

In this embodiment, the tongue 62 is disengaged from the slot aperture 56 by pressing the tab 67 inward against the tongue 62. The tongue moves inward under force from tab 67. When the tab 67 is coplanar with its respective side element 18, the tongue 62 will be free of slot aperture 56 and the top may be opened. This embodiment has advantages over the first embodiment because the finger never breaks the plane of the side element 18 providing a more satisfactory feel.

In other alternative embodiments tongues 62 and tongue panels 60 could be located on the first panel group 72 and the openings 54 could be associated with panels on the second panel group 74. Other embodiments of the container 10 may incorporate other locking engagement mechanisms.

With particular reference to FIG. 6 additional features most easily seen on the blank 11 will be described. Prior to being formed into a container, the blank 11 is formed having a first panel group 72 and a second panel group 74 corresponding to panels that form the top 14 and bottom 12 when the blank is assembled. The first panel group 72 includes the central planar surface 16 having planar side panels 20 and composite side panels 24 located about its perimeter. The side panels 20, 24 are separated from the central surface 16 by score lines 76. Score lines 76 are partial cuts through the container material and are well known in the art. Such score lines permit one panel to be readily folded relative to another along an even predetermined line. The web panels 26 are separated from the connector panels 22 by score lines 78. The connector panels 22 are located contiguous to planar side panels 20 and separated by cut lines 80. Additionally, associated with the second panel group 74 the support panels 64 are separated from their respective side panels 40 by arcuate score lines 82. The score lines 82 are arcuate to increase the resiliency of the hinge connection between the support panel 64 and respective bottom side element 32.

Further, feet 84 are formed by cuts 86 located between connector side panels 40 and the central planar surface 30. When the panels are folded into side elements, the feet protrude downward thus supporting the bottom 12 when the container 10 rests on a flat surface.

Returning to FIGS. 1–5, the preferred embodiment includes eight top side elements 18 and eight bottom side elements 32. Although an octagonal shape is preferred, the invention could be incorporated into polygons having more or less side elements.

Additionally, in a preferred embodiment, the top side elements 18' and 18" alternate, that is, side elements 18' are separated by side elements 18". Apriori, the planar side panels 20 alternate with the composite side panels 24 on the first panel group of the blank 11.

On the second panel group 74 the rear side panel 48 is a composite side panel 40 having connector panels 36. On each side of the rear side panel 48 are composite side panels 42 which have one connector panel 36 each. Accordingly, the second panel group 74 includes adjacent side elements 32' having overlapping panels comprising the two side elements to either side of the rear side panel 48.

Figure 1:
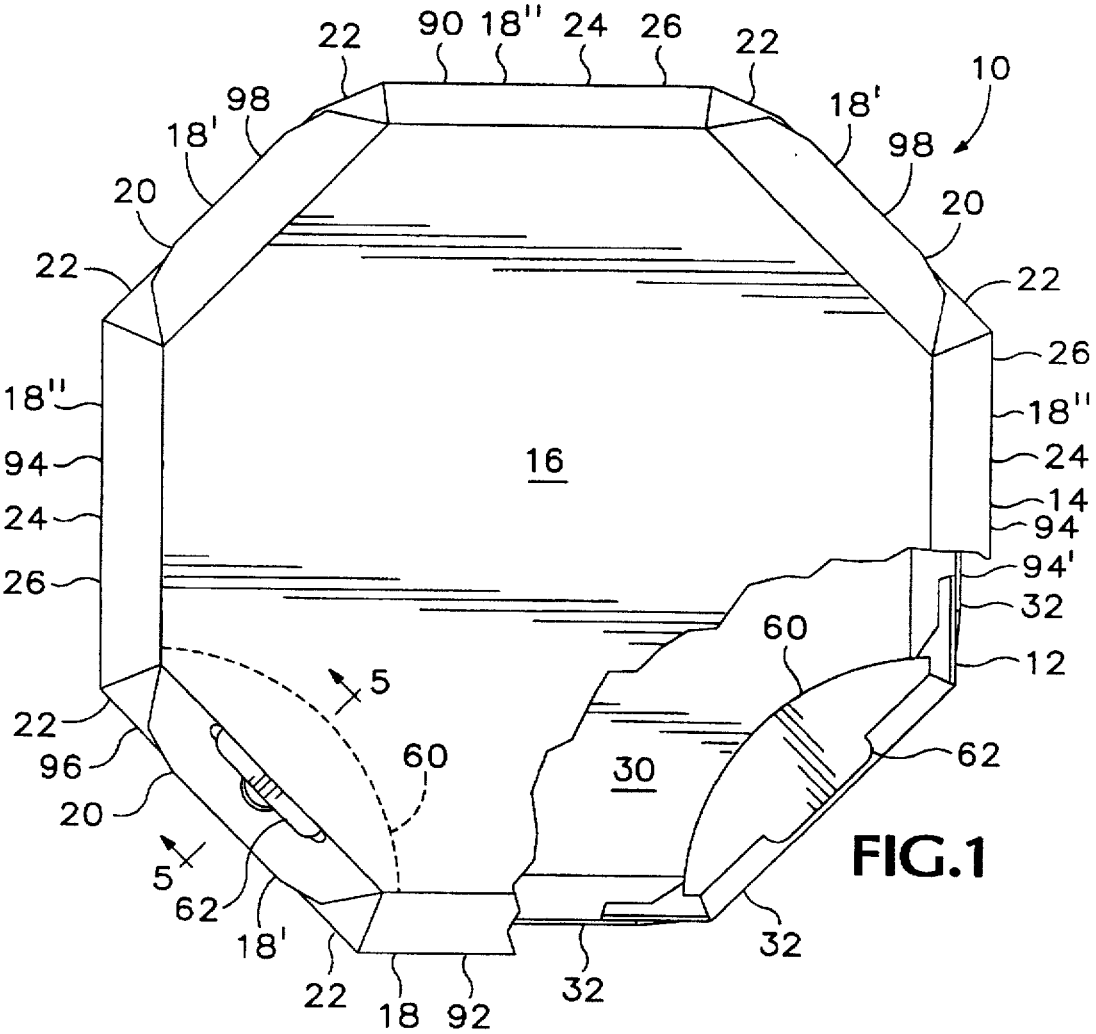
FIG. 1 is a top plan view of a food container of the present invention partially cutaway to show an interior chamber.
Figure 2:
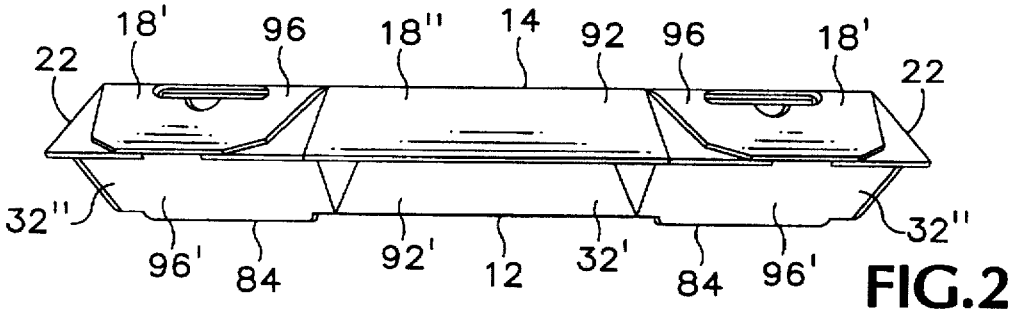
FIG. 2 is front elevation view of the container of FIG. 1.
Figure 3:
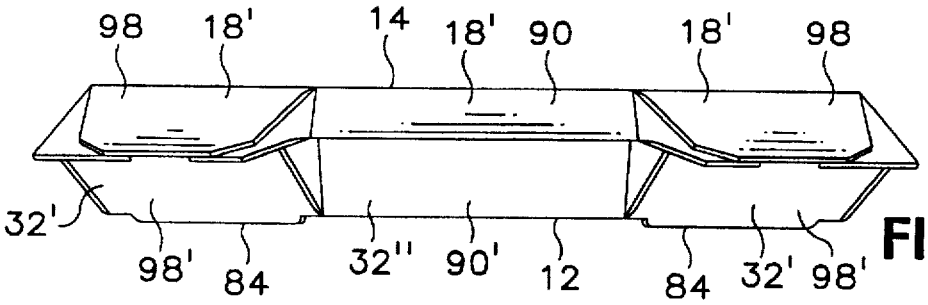
FIG. 3 is a back elevation view of the container of FIG. 1.
Figure 4:
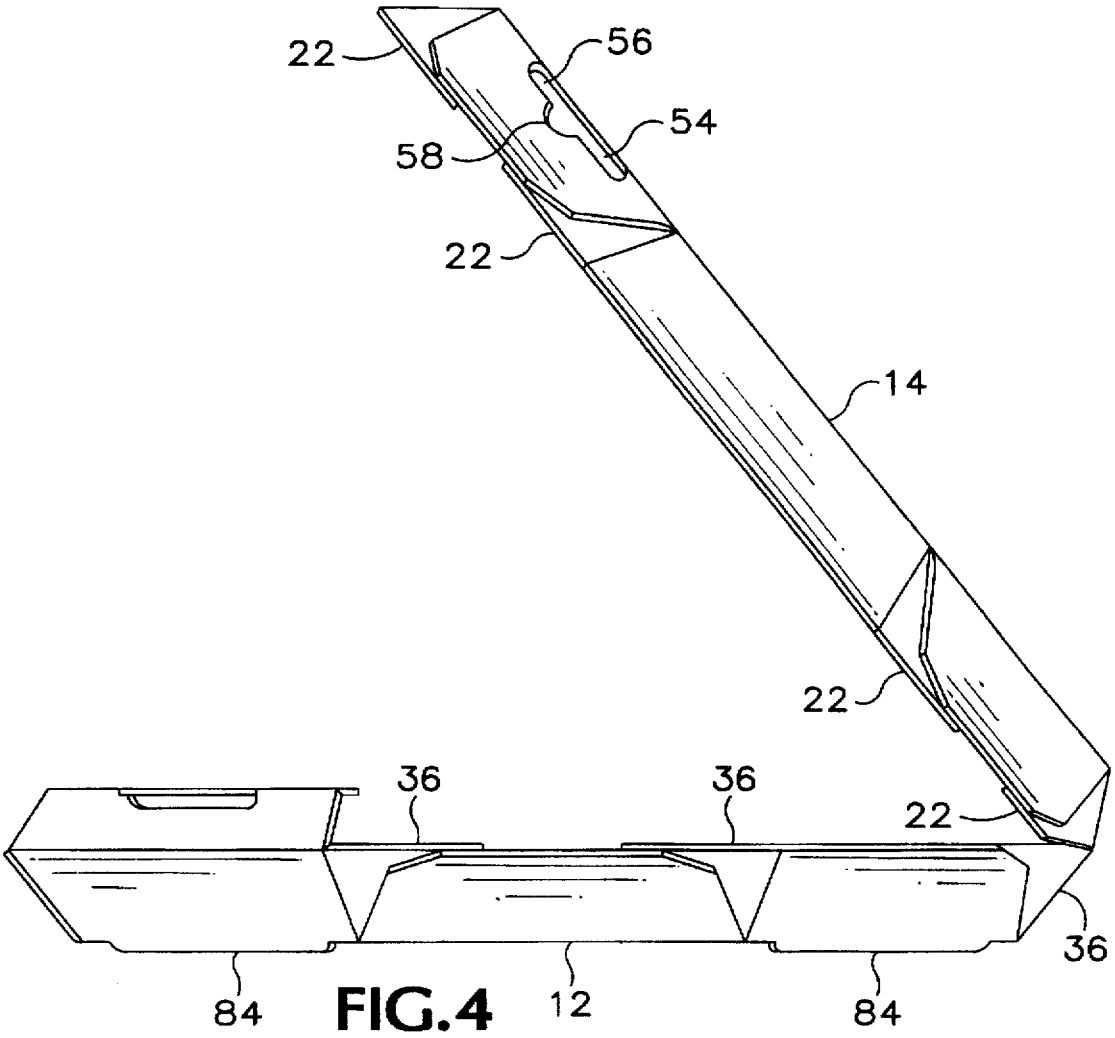
FIG. 4 is a side elevation view of the container of FIG. 1, wherein the container is shown with the top disengaged from the bottom.

As noted, the top includes rear side panel 46 which forms a top rear side element 90 when the blank is formed into the container (FIG. 1). Diagonally across from the top rear side element 90 is a front side element 92. The outward-most side elements are lateral side elements 94. Between the lateral side elements 94 and the front side element 92 are forward bevel side elements 96. Between the lateral side elements 94 and the rear side element 90 are rear bevel side elements 98.

The bottom similarly includes a rear side element 90', a front side element 92', lateral side elements 94', front bevel side elements 96' and rear bevel side elements 98'. Preferably, the tongues 62 and opening 54, which comprise the locking mechanism, are located at the forward bevel side elements 96, 96'.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. A food container, comprising:

(a) a top having a top planar surface and a plurality of top side elements, each top side element extending from the top planar surface at an oblique angle and each top side element coupled to two adjacent top side elements at oblique angles, at least one of said top side elements having an opening; and (b) a bottom having a bottom planar surface and a plurality of bottom side elements, each bottom side element extending from the bottom planar surface at an oblique angle and each bottom side element coupled to two adjacent bottom side elements at oblique angles, at least one of said bottom side elements having a locking tongue; and (c) the top and bottom lockable by engagement of the at least one tongue and one opening so that the top overlies the bottom, and the top side elements overhang at least some of the bottom side elements.

2. The food container of claim 1 wherein the top has eight top side elements and the bottom has eight bottom side elements.

3. The food container of claim 1 wherein the top has eight top side elements, including rear top side elements and front top side elements diametrically opposed to the rear top side elements, and the bottom has eight bottom side elements, including rear bottom side elements and front bottom side elements diametrically opposed to the rear bottom side elements, and the top is hingedly connected to the bottom at the rear top and bottom side elements, and the opening and tongue are located in respective side elements located adjacent the front top and bottom side elements.

4. The food container of claim 1 wherein the top has eight top side elements and the bottom has eight bottom side elements and the top and bottom are hingedly connected along one of said top side elements and one of said bottom side elements and when the top is coupled to the bottom by engagement of the tongue and opening, seven of said top side elements overhang seven of said respective bottom side elements.

5. The food container of claim 1 further comprising feet that support the bottom above a supporting surface when the container is on the supporting surface and the bottom is oriented below the top.

6. The food container of claim 1 wherein at least some of the top side elements have overlapping panels.

7. The food container of claim 1 wherein alternate top side elements have overlapping panels.

8. The food container of claim 1 wherein at least some of the bottom side elements have overlapping panels.

9. The food container of claim 1 wherein alternate five of said bottom side elements have overlapping panels and three of said bottom side elements do not have overlapping panels including one of said bottom side elements that is hingedly connected to one of said top side elements.

10. The food container of claim 1 wherein the top has eight top side elements including a rear top side element, a front top side element, two lateral top side elements and four bevel top side elements and the bottom has eight bottom side elements including a rear bottom side element, a front bottom side element, two lateral bottom side elements and four bevel bottom side elements and the bevel top side elements include overlapping panels and the lateral bottom side elements have overlapping panels.

11. The food container of claim 1 wherein the top has eight top side elements and the bottom has eight bottom side elements and the top side elements include alternate top side elements that have overlapping panels and the bottom side elements include a front bottom side element and two lateral bottom side elements that have overlapping panels.

12. The food container of claim 1 wherein the opening includes an elongate aperture that engages the tongue, and an integral arcuate aperture so that a person can release the tongue from engagement with the elongate aperture by pressing against the tongue.

13. The food container of claim 1 further comprising a tab hingedly coupled to the top side element having the opening, the tab extending at least partially across the opening and wherein a force can be exerted against the tab to press the tab against the tongue thereby moving the tongue out of engagement with the opening.

14. The food container of claim 1 including two locking tongues on two of said bottom side elements wherein the bottom side elements having the locking tongues are separated by one of said bottom side elements having no locking tongue.

15. The food container of claim 1 wherein the bottom side element having a locking tongue is a front bottom side element and another front bottom side element has a second locking tongue, and wherein the side elements having the locking tongues are separated by one of said bottom side elements having no locking tongue, and wherein one of the top side elements has a second opening associated with the second tongue, and wherein the openings each include an elongate aperture that engages the respective tongue, each opening also including an integral semicircular aperture so that a person can release the respective tongue from engagement with the elongate aperture by pressing against the respective tongue thereby decoupling the top and bottom.

16. The food container of claim 1 wherein one of said top side elements is a rear top side element and is less wide than all other top side elements.

17. The food container of claim 1 wherein one of the top side elements is a narrow top side element that is smaller than the other top side elements and the narrow top side element is hingedly connected to one of said bottom side elements.

18. A food container, comprising:

(a) a first piece having a first planar surface and a plurality of first side elements, each of said first side elements extending from the first planar surface at an oblique angle and each of said first side elements coupled to two adjacent first side elements at oblique angles;

(b) a second piece coupled to the first piece and having a second planar surface and a plurality of second side elements, each of said second side elements extending from the second planar surface at an oblique angle and each of said second side elements coupled to two adjacent second side elements at oblique angles; and (c) each of two of said second side elements having a locking tongue and each of two of said first side elements having an opening for engaging one of the tongues so as to lockingly engage the first piece and the second piece thereby defining an interior volume for receiving food.

19. The food container of claim 18 wherein the first piece has eight first side elements and the second piece has eight second side elements.

20. The food container of claim 18 wherein the first piece has eight first side elements and the second piece has eight second side elements and when the first piece is coupled to the second piece by the tongues and openings, a plurality of the first side elements overhang respective second side elements.

21. The food container of claim 18 further comprising feet that support the container above a supporting surface when the container is on the supporting surface and the second piece is oriented below the first piece.

22. The food container of claim 18 wherein the first side elements include bevel side elements that have overlapping panels.

23. The food container of claim 18 wherein every other of said first side elements has overlapping panels.

24. The food container of claim 18 wherein the second side elements include a front side element having overlapping panels and lateral side elements that have overlapping panels.

25. The food container of claim 18 wherein the second side elements include two rear bevel side elements having overlapping panels, two lateral side elements having overlapping panels, and a front side element having overlapping panels.

26. The food container of claim 18 wherein the first piece has eight first side elements and the second piece has eight second side elements and wherein a plurality of the first side elements overhang a respective plurality of the second side elements.

27. The food container of claim 18 wherein each of said openings includes an elongate aperture that engages one of said tongues, each opening also including an arcuate aperture so that a person can release the one tongue from engagement with the respective elongate aperture by pressing against the one tongue, thereby lockingly disengaging the first piece and second piece.

28. The food container of claim 18 wherein the two second side elements having the locking tongues are separated by one of said second side elements having no locking tongue.

29. The food container of claim 18 wherein the first piece has eight first side elements and the second piece has eight second side elements and the first side elements include four side elements that have overlapping panels and the second side elements include five side elements that have at least one overlapping panel, and wherein a plurality of the first side elements overhang a respective plurality of the second side elements when the first piece is lockingly engaged with the second piece and wherein each of the openings includes an elongate aperture that engages one of the tongues, and also includes an arcuate aperture so that a person can press against the tongue to release the tongue from engagement with the elongate aperture, thereby decoupling the first piece and second piece.

30. The food container of claim 18 wherein one of the first side elements is a rear first side element that is less wide than all other first side elements.

31. The food container of claim 18 wherein one of the first side elements is a narrow side element that is smaller than the other first side elements and the narrow side element is hingedly connected to one of the second side elements.

32. The food container of claim 18 wherein the openings are cutouts on said two first side elements and the locking tongues are located on tongue panels that are hingedly coupled to support panels, the support panels being hingedly coupled to two of said second side elements.

33. The food container of claim 18 wherein the openings are cutouts on said two first side elements and the locking tongues are located on tongue panels that are hingedly coupled to hinge panels that are hingedly coupled to two of said second side elements, the tongues being coplanar with the respective tongue panels and oblique to the respective hinge panels.

34. The food container of claim 18 further comprising a tab hingedly coupled to one of said first side elements, the tab being located proximate one of the openings and arranged so that a force against the tab presses the tab against the respective tongue and moves the tongue into disengagement with the one opening.

35. A blank for forming a food container, comprising:

(a) a planar, unitary piece of container material, the piece having a plurality of panels defined by cut lines and score lines, the panels including a first panel group and a second panel group, the first panel group being hingedly connected to the second panel group;

(b) the first panel group comprising a first central panel having a plurality of first side panels coupled to a perimeter of the first central panel and separated from the first central panel by score lines, the plurality of first side panels including composite first side panels having a first web panel and at least one first connector panel separated from the first web panel by at least one score line, the plurality of first side panels further including first planar side panels comprising a single planar panel, the first connector panels being proximate to the first planar side panels and separated from the first planar side panels by cut lines, at least one of the first side panels having an opening, one of the first side panels having a hinge connection connecting the first panel group to the second panel group;

(c) the second panel group comprising a second central panel having a plurality of second side panels coupled to a perimeter of the second central panel and separated from the second central panel by score lines, the plurality of second side panels including second composite side panels having a second web panel and at least one second connector panel separated from the second web panel by at least one score line, the plurality of second side panels also including second planar side panels comprising a single planar panel, the second connector panels being proximate to the second planar side panels and separated from the second planar side panels by cut lines, at least one of the second side panels having a support panel and a tongue panel connected thereto, the tongue panel including a locking tongue for engaging the opening, one of the second side panels having a hinge connection connected to the first side panel having a hinge connection.

36. The blank of claim 35 wherein at least three of the second side panels are defined by said score and cut lines separating the three second side panels from the second central panel, the cut lines further defining feet that extend away from the second central panel when these second side panels are bent out of a coplanar relationship with the second central panel.

37. The blank of claim 35 wherein the first panel group has eight first side panels.

38. The blank of claim 37 wherein the second panel group has eight second side panels.

39. The blank of claim 35 wherein the first side panel that has a hinge connection has a width that is more narrow than a width of a plurality of the other first side panels.

40. A food container, comprising:

(a) a first part having a first central planar surface and depending first side elements;

(b) a second part having a second central planar surface and depending second side elements;

(c) a lock mechanism comprising a receiving portion and an engaging portion, the receiving portion comprising one of the first side elements, which has an aperture, and a proximately located hingedly connected tab that at least partially extends over a portion of the aperture, the engaging portion comprising one of the second side elements, which has a hingedly coupled tongue, and in which insertion of the tongue into the aperture latches the first part to the second part and a force against the tab urges the tab against the tongue to move the tongue out of the aperture thereby disengaging the first part from the second part.

41. The container of claim 40 wherein the tab is biased toward the tongue.

42. The container of claim 40 wherein the tab is formed by cut lines in said one of the first side elements and is resiliently hinged to said one of the first side elements and the tongue moves the tab away from the aperture when the tongue is inserted into the aperture and the tab is biased into contact with the tongue.

43. The container of claim 40 wherein the first part is above the second part and the aperture is proximate and below the first planar surface.

44. The container of claim 40 wherein the tongue is a portion of a tongue panel and further comprising a support panel that is hingedly coupled to the second side element of the engaging portion and the tongue panel is hingedly coupled to the support panel.

45. The container of claim 40 wherein the first part is above the second part and the aperture is proximate and below the first planar panel and the tab is defined by cut lines and resiliently biased toward a major plane of the first side element of the receiving portion and the tongue moves the tab away from the first side element of the receiving portion when the tongue is engaged with the aperture, and moving the tab into substantial coplanar arrangement with the first side element disengages the tongue from the aperture.

46. The container of claim 40 wherein the tongue disengages from the aperture when the tab is substantially coplanar with the first side element of the receiving portion.

* * * * *